US011944884B2

(12) United States Patent
Baxter et al.

(10) Patent No.: US 11,944,884 B2
(45) Date of Patent: Apr. 2, 2024

(54) REINFORCED DIE FOR USE IN A THROWING GAME AND METHOD OF MANUFACTURE OF SAME

(71) Applicant: Pipfall LLC, Columbia, TN (US)

(72) Inventors: David R Baxter, Columbia, TN (US); Michael A McNutt, Spring Hill, TN (US); Susan E Norwood, Columbia, TN (US)

(73) Assignee: PIPFALL LLC, Columbia, TN (US)

( * ) Notice: Subject to any disclaimer, the term of this patent is extended or adjusted under 35 U.S.C. 154(b) by 112 days.

(21) Appl. No.: 17/494,228

(22) Filed: Oct. 5, 2021

(65) Prior Publication Data

US 2023/0104523 A1 Apr. 6, 2023

(51) Int. Cl.
*A63B 67/06* (2006.01)

(52) U.S. Cl.
CPC ..... *A63B 67/06* (2013.01); *A63B 2209/00* (2013.01)

(58) Field of Classification Search
CPC ..... A63B 67/06; A63B 2209/00; A63B 43/00; A63B 43/002
USPC ..... 273/146
See application file for complete search history.

(56) References Cited

U.S. PATENT DOCUMENTS 3,480,280 A * 11/1969 Gamertsfelder ..... A63B 67/06 473/594
3,518,786 A * 7/1970 Holtvoigt ..... A63H 33/04 446/85
4,354,679 A * 10/1982 Steinmetz ..... A63B 37/02 473/594
4,971,334 A * 11/1990 Stewart ..... A63B 43/005 473/573
5,078,408 A * 1/1992 Myers ..... A63B 43/002 473/569
5,100,152 A * 3/1992 Butler, III ..... A63B 43/005 473/573
2008/0116632 A1* 5/2008 Russell ..... A63F 1/06 273/148 A (Continued)

FOREIGN PATENT DOCUMENTS

BR 202015025083 U2 * 4/2017
WO WO-9416778 A1 * 8/1994 ..... A63B 43/002

OTHER PUBLICATIONS https://en.wikipedia.org/w/index.php?title=Dice&oldid=1043563776, printed Oct. 4, 2021.

(Continued)

*Primary Examiner* — Steven B Wong
(74) *Attorney, Agent, or Firm* — Leonid Kisselev

(57) ABSTRACT

A reinforced die for use in a throwing game and method of manufacture of same are provided. Having corners reinforced with multiple rows of machine stitched threads, multiple layers of inner lining padding the corners, and filler material within the inner lining layers helps the die maintain distinct sides and resist deformation even after being thrown extensively against a hard surface. The use of machine stitching to reinforce the die allows to impart uniform strength to all sides of the die, further increasing resistance to deformation. The material of the housing, such as duck cloth, is weather resistant, durable, and has a friction coefficient that is high enough to prevent excessive sliding of the die from a board upon which the die is thrown, but low enough to prevent damage to the board.

9 Claims, 8 Drawing Sheets

(56) References Cited

U.S. PATENT DOCUMENTS

2016/0325166 A1* 11/2016 Wallace ..... A63B 41/00
2018/0214756 A1* 8/2018 Llamas ..... A63B 69/002

OTHER PUBLICATIONS https://en.wikipedia.org/w/index.php?title=Cornhole&oldid=1043045668, printed Sep. 22, 2021.

* cited by examiner

REINFORCED DIE FOR USE IN A THROWING GAME AND METHOD OF MANUFACTURE OF SAME

FIELD

This application relates in general to recreational equipment, and in particular, to a reinforced die for use in a throwing game and method of manufacture of same.

BACKGROUND

While variations of the game of cornhole have been around since the 19$^{th}$ century, the gaming industry keeps evolving and equipment that is suitable for playing the traditional version of cornhole no longer works for certain variations of the game. For example, whereas the traditional game of cornhole involves throwing bags of corn kernels ("cornhole bags") onto a wooden board, such bags are not suitable a variation of the corn hole game called Pipfall™ created by Pipfall, LLC of Columbia, Tennessee. In the game of Pipfall®, dice marked with dots ("pips") are thrown onto a cornhole board, and the score from each throw is determined based on the number of dots on the side of the die that lands on top when the die lands on top of the cornhole board.

Existing equipment for cornhole and other games are not suitable for playing a game such as Pipfall®. For example, cornhole bags are too amorphous and even if markings signifying a score were added to them, one would not be able to determine what score results from a throw. In particular, due to a lack of permanent, defined, corners, one would not be able to tell which marking is on a top side of the bag. Further, as the fabric cornhole bags are traditionally made of quickly lose elasticity, whatever shape cornhole bags have further changes as the bags are thrown a multitude of times.

Similarly, existing dice are not suitable for such a game. For example, dice made of wood, rubber, or plastic are often used for gaming purposes. However, dice made of wood will damage the cornhole board upon landing, thus making such dice unsuitable for prolonged use. Plastic dice of a suitable size are generally too light and their path when thrown is easily affected by wind, making them ill-suited for a game in which a proper aim is of prime importance. Finally, rubber dice tend to bounce off a wooden surface, once again making them unsuitable for a game whose aim is to land the dice onto a wooden board.

Accordingly, there is a need for a throwable object that retains distinct sides upon landing and can be used for an extended period without being deformed, has aerodynamic properties suitable for use in a throwing game, and neither damages nor bounces off a hard surface when landing upon the surface.

SUMMARY

The die described below addresses the shortcomings of prior recreational equipment. Having corners reinforced with multiple rows of machine stitched threads, multiple layers of inner lining padding the corners, and filler material within the housing helps the die maintain distinct sides and resist deformation even after being thrown extensively against a hard surface. The use of machine stitching to reinforce the die allows to impart uniform strength to all sides of the die, further increasing resistance to deformation. The material of the housing, such as duck cloth, is weather resistant, durable, and has a friction coefficient that is high enough to prevent excessive sliding of the die from a board upon which the die is thrown, but low enough to prevent damage to the board.

In one embodiment, a reinforced die for use in a throwing game is provided. The die includes a substantially cube-shaped housing including a plurality of pieces of fabric, each of the pieces of fabric including multiple layers, the housing included a plurality of sides, each side associated with a score used for a game, each corner of the housing comprising the fabric pieces joined by at least two threads applied via two applications of machine stitching, wherein one of the threads is applied with the fabric pieces being right side in and another one of the threads is applied with the fabric pieces being right side out; and a filler material inside the housing, wherein upon landing following being thrown during the game, the housing retains the substantially cube-shaped shape due to the filler material and the corners being formed via the two applications of machine stitching, and wherein one of the sides is a top side of the die upon the landing.

In a further embodiment, a method for manufacturing a reinforced die for use in a throwing game is provided. Six substantially-square pieces of fabric, each of the pieces of fabric including multiple layers, each of the pieces of fabric comprising a central portion, two side portions, a top portion, and a bottom portion. A base of a housing of a die is formed using four of the pieces of fabric, wherein each of the pieces of fabric is machine stitched to only two other ones of the remaining pieces of fabric and wherein only the side portions of each of the fabric pieces are machine stitched to each other. The housing is formed, including: machine stitching a portion of a further one of the fabric pieces to at least a portion of each of the top portions of each of the fabric pieces in the housing base, wherein the machine stitching is applied with the further fabric piece being right side in; machine stitching an additional one of the fabric pieces to at least a portion of each of the bottom portions of each of the fabric pieces in the housing base, wherein the machine stitching is applied with the further fabric piece being right side in, wherein the fabric pieces, the further fabric piece, and the additional fabric piece each associated with a score in a game. Reinforced corners of the housing are formed, including machine stitching together further portions of each of the top portion to the further fabric piece and machine stitching further portions of the ends of the bottom portion of each of the fabric, wherein the fabric pieces are right side out when the machine stitching is performed during the reinforcement and an opening between one of the fabric pieces and one of the further fabric piece or the additional fabric remains following the reinforcement of the corners. Filler material is put into the housing via the opening. The opening is closed by machine stitching portions of the fabric piece adjacent to the opening to one of the portions of the further fabric piece adjacent to the opening or portions of the additional fabric adjacent to the opening, wherein upon landing following being thrown during the game, the housing retains the substantially cube-shaped shape due to the filler material and the corners being formed via the two applications of machine stitching, and wherein one of the markings is at a top of the housing upon the landing.

Still other embodiments of the present invention will become readily apparent to those skilled in the art from the following detailed description, wherein is described embodiments of the invention by way of illustrating the best mode contemplated for carrying out the invention. As will be realized, the invention is capable of other and different embodiments and its several details are capable of modifications in various obvious respects, all without departing from the spirit and the scope of the present invention. Accordingly, the drawings and detailed description are to be regarded as illustrative in nature and not as restrictive.

DETAILED DESCRIPTION

Figure 1:
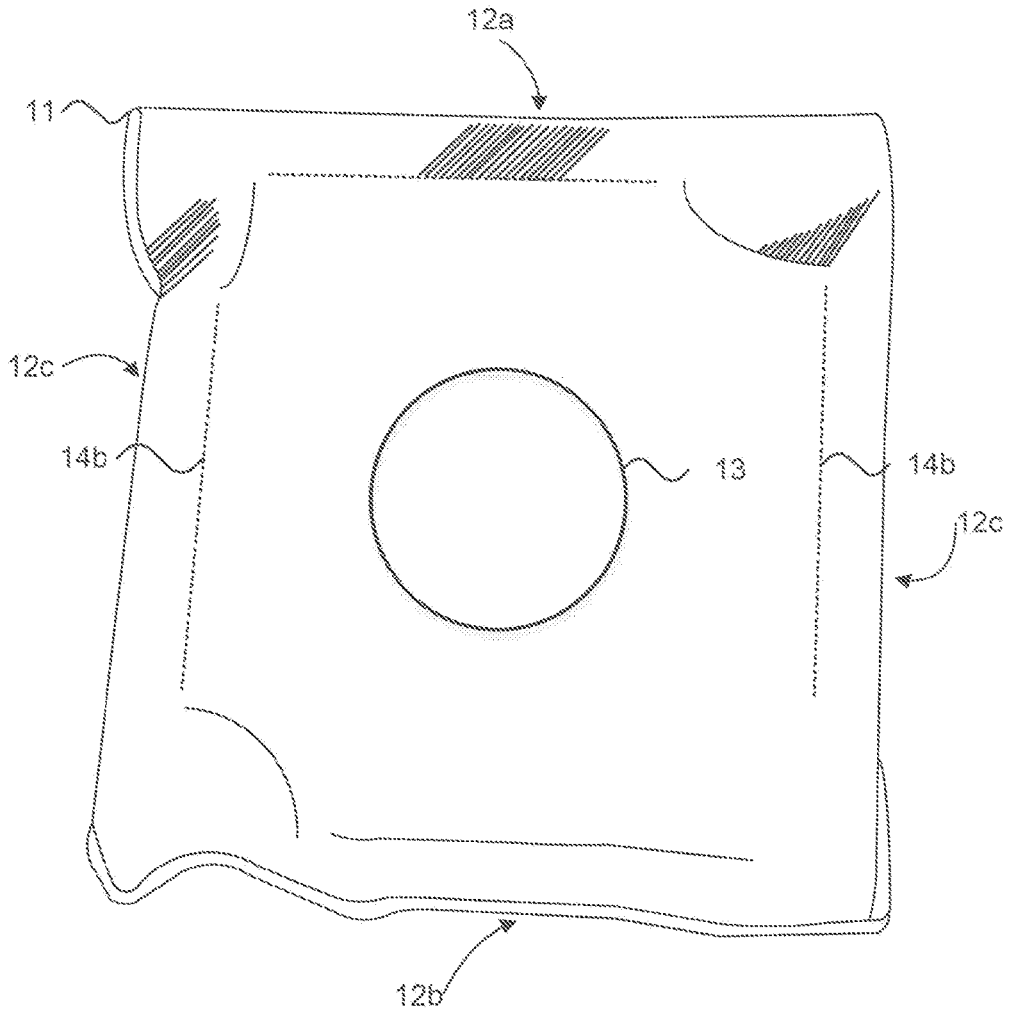
FIG. 1 is a diagram showing a top view of a reinforced die for use in a throwing game in accordance with one embodiment.

While the die described below can be used in the game of Pipfall®, the die could also be used in other throwing games. FIG. 1 is a diagram showing a top view of a reinforced die 10 for use in a throwing game in accordance with one embodiment. While FIG. 1 and subsequent figures include shading, such shading is used to emphasize features of the die 10 and does not have to be physically present on the die 10. The die 10 includes a substantially cube-shaped housing 11, the housing including six sides 12*a*-12*c*. Each side 12*a-c* is associated with a score (which can be used in the game such as Pipfall), which can be indicated by markings 13 (such as dots, though other kinds of markings, such as numbers, letters, or other symbols, are possible) on each side 13. In a further embodiment, an absence of a markings 13 can also indicate a score associated with a side 13. In one embodiment, the dimensions of the die 10 can be substantially 3.5 inches by 3.5 inches by 3.5 inches (with each side being substantially 3.5 inches), and weighing 380-400 grams, though other dimensions and weight are also possible.

As further described below, the die 10 includes multiple layers of material. The outermost layer of which the housing 11 is composed and which is seen with reference to FIG. 1 can be made of duck cloth, which has a high enough friction coefficient to make the housing 10 unlikely to slide off a wooden board upon landing on the board following a throw, but low enough friction coefficient not to damage a wooden board when landing. Further, duck cloth is weather-resistant and is highly durable, contributing to the longevity of the die 10. In a further embodiment, other types of fabric materials are possible as the outer layer of the die.

As one of the important properties the die 10 must possess is retaining a well-defined, substantially-cube-like shape after being thrown and landing on a hard surface (such as a wooden board) thousands of times, the housing 11 has several features that contribute to the resistance to deformation of the housing's 11 shape. As further described below, the housing 11 is joined together by a plurality of threads 14*a,b*. All of the threads 14*a,b* are applied to components of the housing 10 using machine stitching, which ensures a uniformly high strength of the applied stitches throughout the housing 11, thus reducing the possibility that the housing 11 will become deformed due to different tension applied by the threads 14*a,b* in different parts of the housing 11. In one embodiment, each of the threads 14*a,b* is a 2-strand thread and has a thread weight of 200 grams, though in a further embodiment, other kinds of threads or combination of threads are possible.

Figure 2:
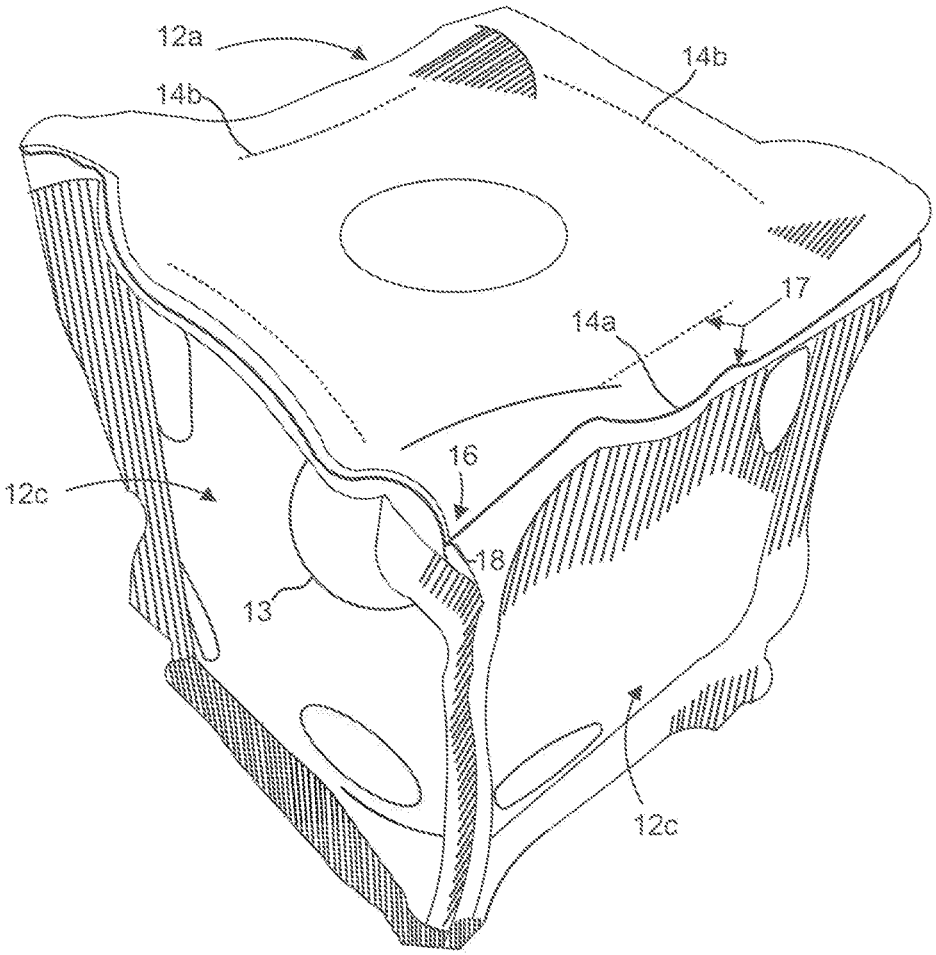
FIG. 2 is a diagram showing a perspective view of the die of FIG. 1 in accordance with one embodiment.

Another feature of the die 10 that contributes to the resistance of the housing 10 to deformation are reinforced corners of the die 10. FIG. 2 is a diagram showing a perspective view of the die of FIG. 1 in accordance with one embodiment. Each of the corners 16 is formed by a joining of three sides 12*a-c* of the housing: either a top 12*a* or a bottom sides 12*b* that is joined to two of the lateral sides 12*c*. The portions of the lateral sides 12*c* forming each of the corners 16 are each joined to portions of the top side 12*a* (for top corners 16) or the bottom side 12*b* (for bottom corners 16) by at least two threads 14*a,b*. One of the threads 14*a* applied is machine stitched to the fabric portions forming the corners (12*a* and 12*c* or 12*b* and 12*c*). In one embodiment, when the innermost layer (identified by numeral 44 below) of the fabric piece (identified by numeral 24 below) that will make up one of the sides 12*a*-12*c* is facing the needle of the sewing machine before the machine stitching application begins. Generally, such position would be furthest away from the ground and in the description below, when an innermost layer 44 of a fabric piece 24 is facing the needle of a sewing machine, such position is referred to that fabric piece being "right side in." Likewise, when an outermost layer (identified by numeral 43 below) of a fabric piece 24 is facing the needle of the sewing machine before the machine stitching application begins, such position is referred to the fabric piece being "right side out." The second one of the threads 14*b* is applied with the fabric piece (identified by numerals 41, 42 below) that will make up one of the sides 12*a*-12*c* being right side out. The two threads 14*a,b* are some distance from each other, as illustrated by the arrow 17. Thus, some of the threads 14*a* run at the edges of the housing 11 and converge (convergence shown by numeral 18) at the corners 16 of the housing 11. Other threads 14*b* that run on the inner portion of the housing 11 (when compared to the threads 14*a* running at the edges) do not converge. The use of two sets of threads 14*a,b* to define each of the corners 16 strengthens the corners 16, helping to preserve the overall shape of the after the housing 11 is thrown a multitude of times.

The die 10 has eight corners 16, and six of the corners 16 are joined together by the same threads 14*a,b* as another one of the corners 16. For these corners 16, the threads 14*a*, 14*b* run throughout the lengths of the sides 12*a*-12*c*, between the corners 16 until reaching the appropriate converge points 18 (or in the case of threads 14*b*, running through the greater part of the side 12*a-c* on which that thread 14*b* is applied). The use of the continuous threads 14*a,b* adds additional strength to the housing 11.

Figure 3:
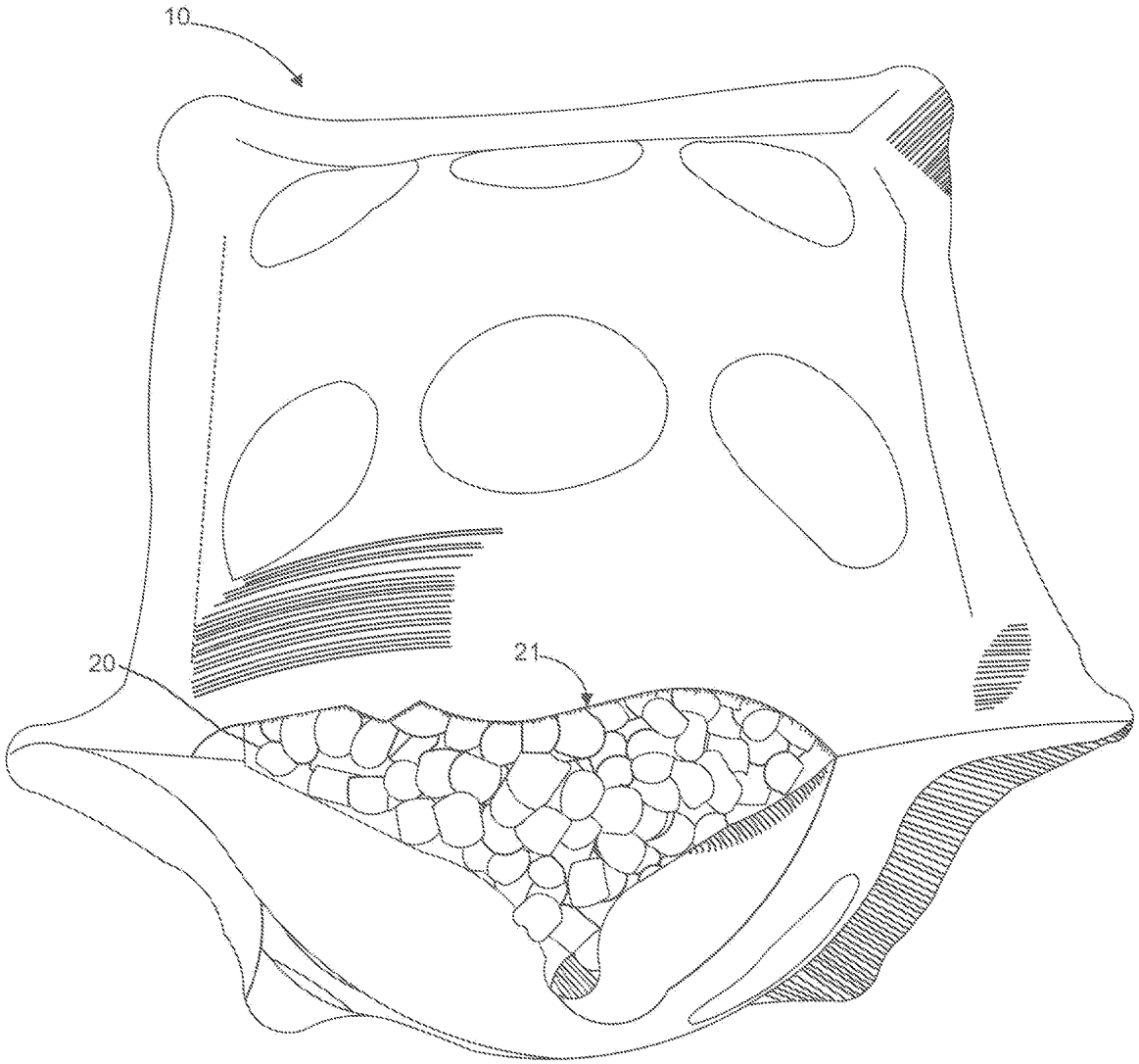
FIG. 3 is a diagram showing an opening in the housing of the die of FIG. 1 used to put filler material into the die in accordance with one embodiment.

Two of the remaining corners 16 are formed using threads 14*a*, 14*b* different from threads 14*a*, 14*b* used to form all other corners 16. This difference in the application of the other threads 14*a*, 14*b* is due to a necessity to create an opening during construction of the die 10, as illustrated by FIG. 3. FIG. 3 is a diagram showing an opening 21 in the housing 11 of the die 10 of FIG. 1 used to put filler material 20 into the die 10 in accordance with one embodiment. A piece of fabric that is also used as a filler (identified by numeral 45 below and referred to as "filler fabric"), described further below, can also be added through the opening 21 after the filler material 20 is added into the die 10. The filler fabric 45 is loose, not attached to the material making up the housing 11, but prevents the filler material 20 from falling out of the housing 10 when the opening is being closed. Following the addition of filler fabric 45 and the filler material 20, the opening is closed by machine stitching together portion of the top (relative to the orientation of FIG. 3) side 12*a* and portion of a lateral slide 12*a* by applying two threads 14*a*, 14*b*, with the fabric pieces 24 being stitched together being right side out.

The filler material 20 fills at about three-quarters of available space inside the housing 11. In a further embodiment, more than three quarters of available space could be filled with the filler material 20, but not the entirety of the available space (which would make closing the opening 20 difficult). In one embodiment, the filler material 20 can be polyethylene pellets. While polyethylene is a particularly suitable as the filler material 20 due to the pellets not rotting over time (as happens with corn used to fill traditional cornhole bags), even if exposed to moisture, other types of filler material are possible 20. Further, shapes of the filler material 20 other than pellets are possible. As mentioned above, placing the filler fabric 45 on top of the filler material 20 prevents the filler material from spilling out the housing 11 when the opening 21 is being closed. Also, as not the entirety of the available space inside the housing is filled with the material and the additional fabric 45, flexibility exists for the fabric 45 and the filler material 20 to move around within the housing, which in turn provides additional flexibility to the die 10 as a whole as compared to if the die 10 was fully packed. Further, while the filler fabric 45 is large enough to cover the filler material from at least direction, in a further embodiment, the filler fabric 45 could envelop the filler material 20 from multiple sides.

Figure 8:
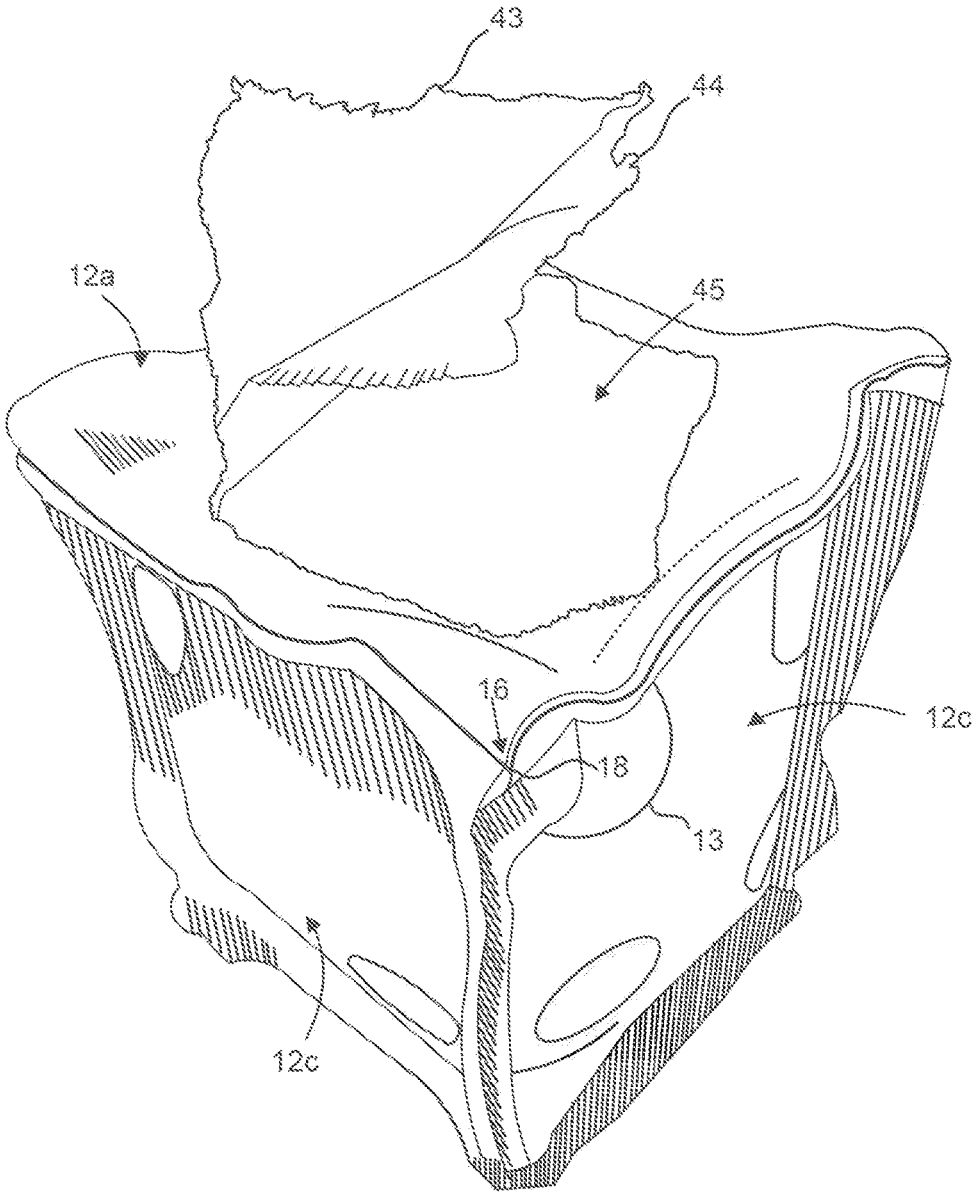
FIG. 8 is a diagram illustrating layers of lining of the die of FIG. 1 in accordance with one embodiment.

Further, between the fabric pieces (such as duck cloth) making up the outer surface layer 43 of the housing 11 and the filler material 20 is one or more layers of inner lining (which can also be referred to as fabric). In particular, each fabric piece in the outermost layer is fused to at least one layer of inner lining, as illustrated by FIG. 8. FIG. 8 is a diagram illustrating multiple layers 43, 44, 45 of lining of the die 10 in accordance with one embodiment. As mentioned above and as further described below, at least one layer 44 of inner lining is fused to the outer layer 43 of the housing 11. As further described below, the fusion of the inner layers 44 to the outer layer 43 can be accomplished by gluing together around the edges one of the inner lining layer 44 to a piece of fabric that eventually makes up an outer layer 43 on one side 12*a*-12*c* of the housing 11 visible in the FIGS. 1-3, 8 (and thus can also be identified in the drawings by the numerals 12*a*-12*c*). In a further embodiment, additional layers of inner lining could be fused to the outer layer in the same manner. In a further embodiment, the layers could be fused together in ways other than gluing.

As the outer layer and the inner layers are fused only around the edges, the central parts of the inner layer 44 and the outer layer 43 are not fused to each other and can move freely of each other to an extent permitted by the fused edges. The view of FIG. 8 shows the layers 43, 44 as well as the fabric filler 45 as they would be visible if the housing 11 was cut open. In one embodiment the inner lining layer 44 can be made of polyester, such as 300D polyester, though other kinds of materials are also possible. The fabric filler 45 can be made of a soft fabric (fabric of density less than 300*d*), though other kinds of fabric (or other materials) are also possible. In a further embodiment, more than three layers of inner lining are possible.

Figure 4:
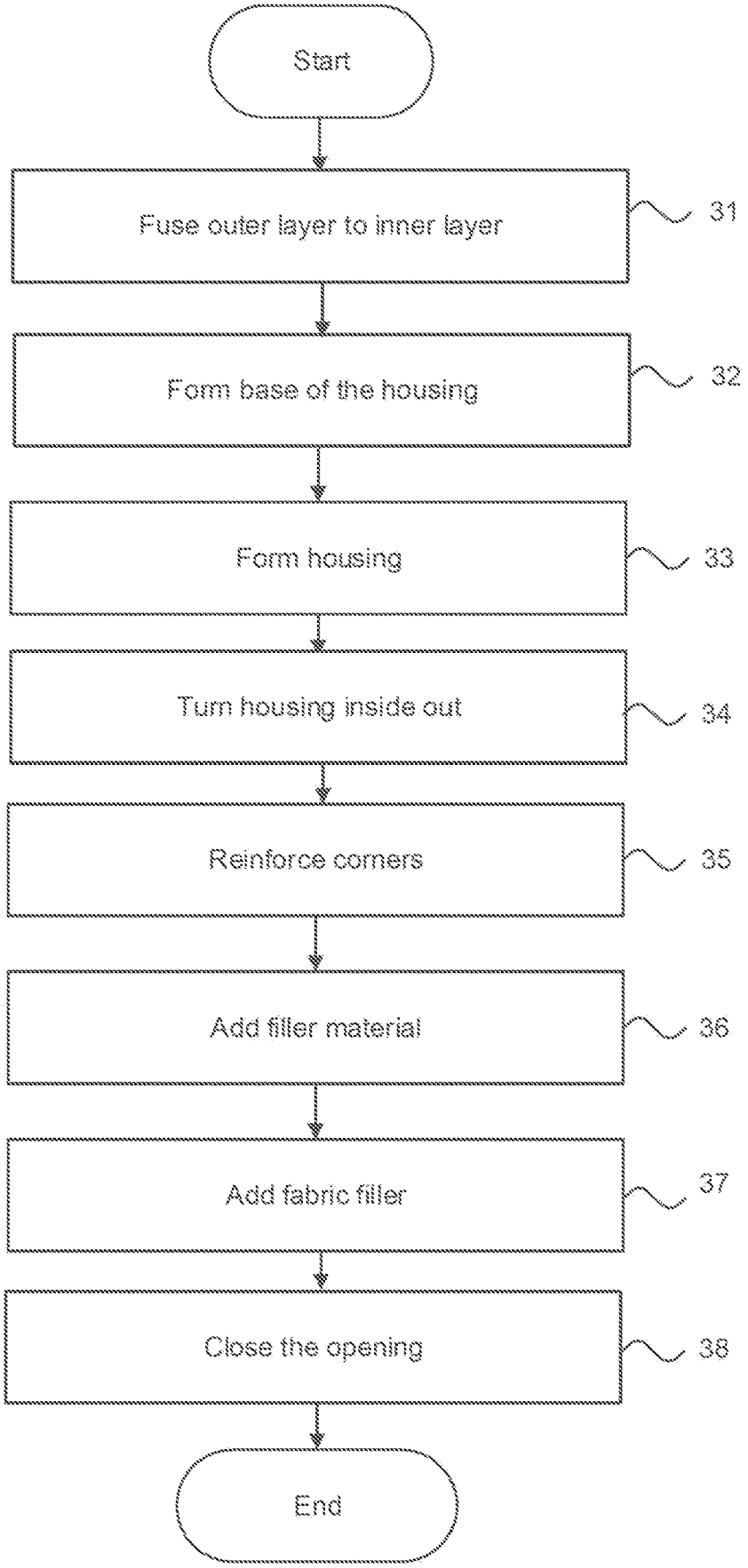
FIG. 4 is a method for manufacturing a reinforced die for use in a throwing game in accordance with one embodiment.
Figure 5:
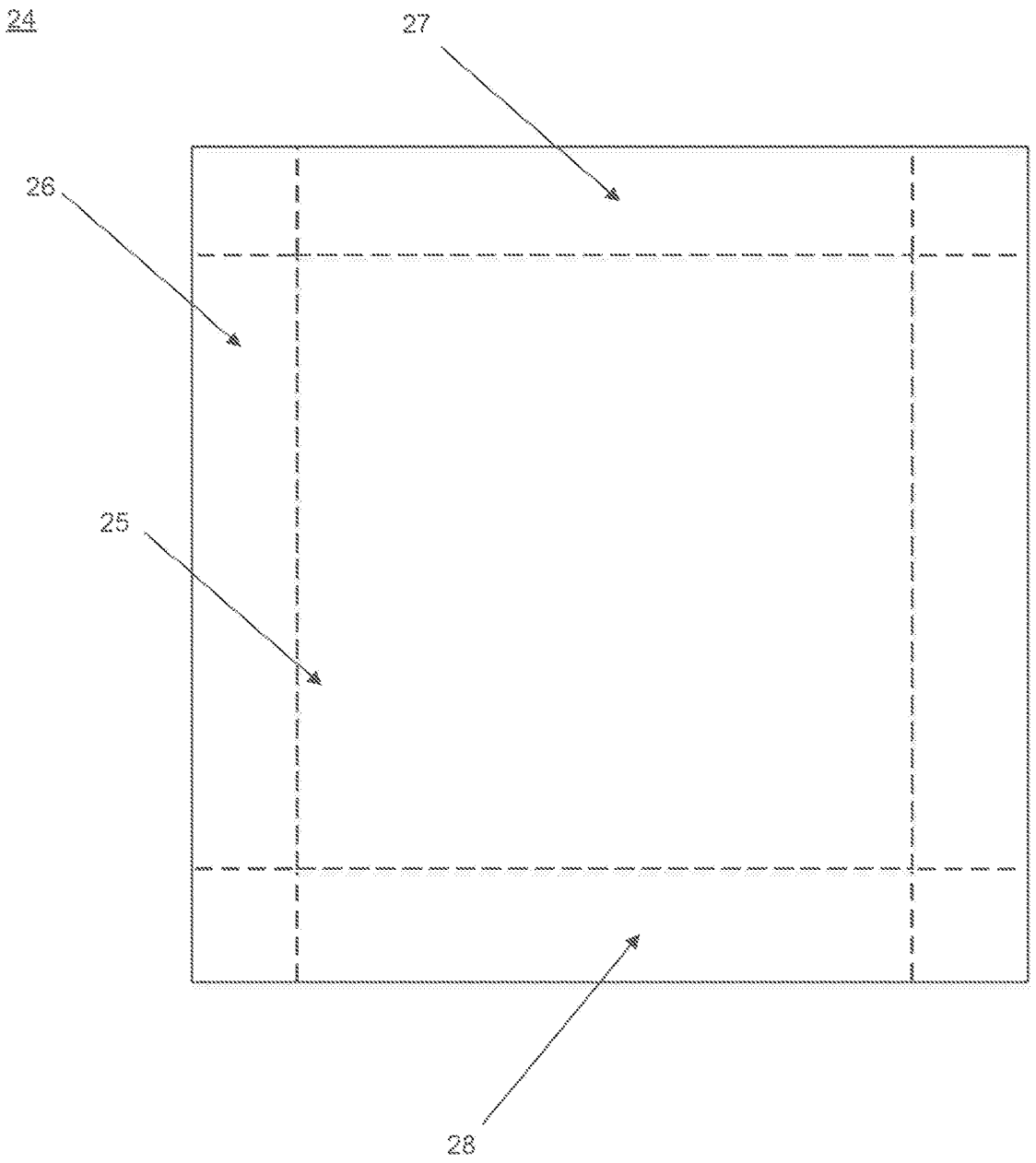
FIG. 5 is a diagram showing one of the four fused pieces of fabric used to form the housing base in accordance with one embodiment.

Producing the die 10 as described below ensures that the die is uniformly strong on all sides. FIG. 4 is a method 30 for manufacturing a reinforced die 10 for use in a throwing game in accordance with one embodiment. The method 30 can be used to make the die 10 of FIG. 1. Initially, each of the fabric pieces that will make up the outer layer 43 of the sides 12*a*-12*c* of the housing are fused to at least one piece of inner lining 44 (step 31). The pieces of fabric forming the outer layer 43 and pieces of fabric forming the inner layer lining 44 are of the same shape, and thus can be fused (such through being glued together, though other fusion techniques are possible) only at the edges of all of the pieces. The resulting fused material pieces 24 (also referred to as fused fabric pieces 24) can be then used to form a base of the housing 11, which is used during subsequent manufacturing. FIG. 5 is a diagram showing one of the four fused material pieces 24 (formed by the fabric used to form the outer layer 43 of the housing 11 fused to the inner lining layer 44) used to form the housing base 29 in accordance with one embodiment. For purposes of the discussion, the fused material piece 24 is represented as separated into different sections with boundaries between sections represented by dashed lines, though such dashed lines do not have to be physically present on the fused material piece 24. Further, for purposes of simplicity, the side of the fused fabric piece 24 that does not have markings 13 is shown with reference to FIG. 5. Thus, the fused material piece 24 can have a central portion 25, two side portions 26, a top portion 27, and a bottom portion 28. The side portions 26, the bottom portion 28, and the top portions 27 are structurally identical and the names of the sections are in reference to orientation to the fabric piece 24 shown in FIG. 5. If the orientation of the fused material piece 24 is flipped, a side portion 26 could be a top portion 27 or a bottom portion 28, while a top portion 28 could become a side portion 26 or a bottom portion 28, and a bottom portion 28 could become a side portion 26 or a top portion 27. Also, as can be seen with reference to FIG. 5, the side portions 26 overlap with the top portion 27 and a bottom portion 28. The glue holding the different layers of each fused fabric piece 24 together can be applied along the top portion 27, the bottom portion 26, and the side portions 28, allowing the central portions 25 of each of the layers to move freely of each other.

Figure 6:
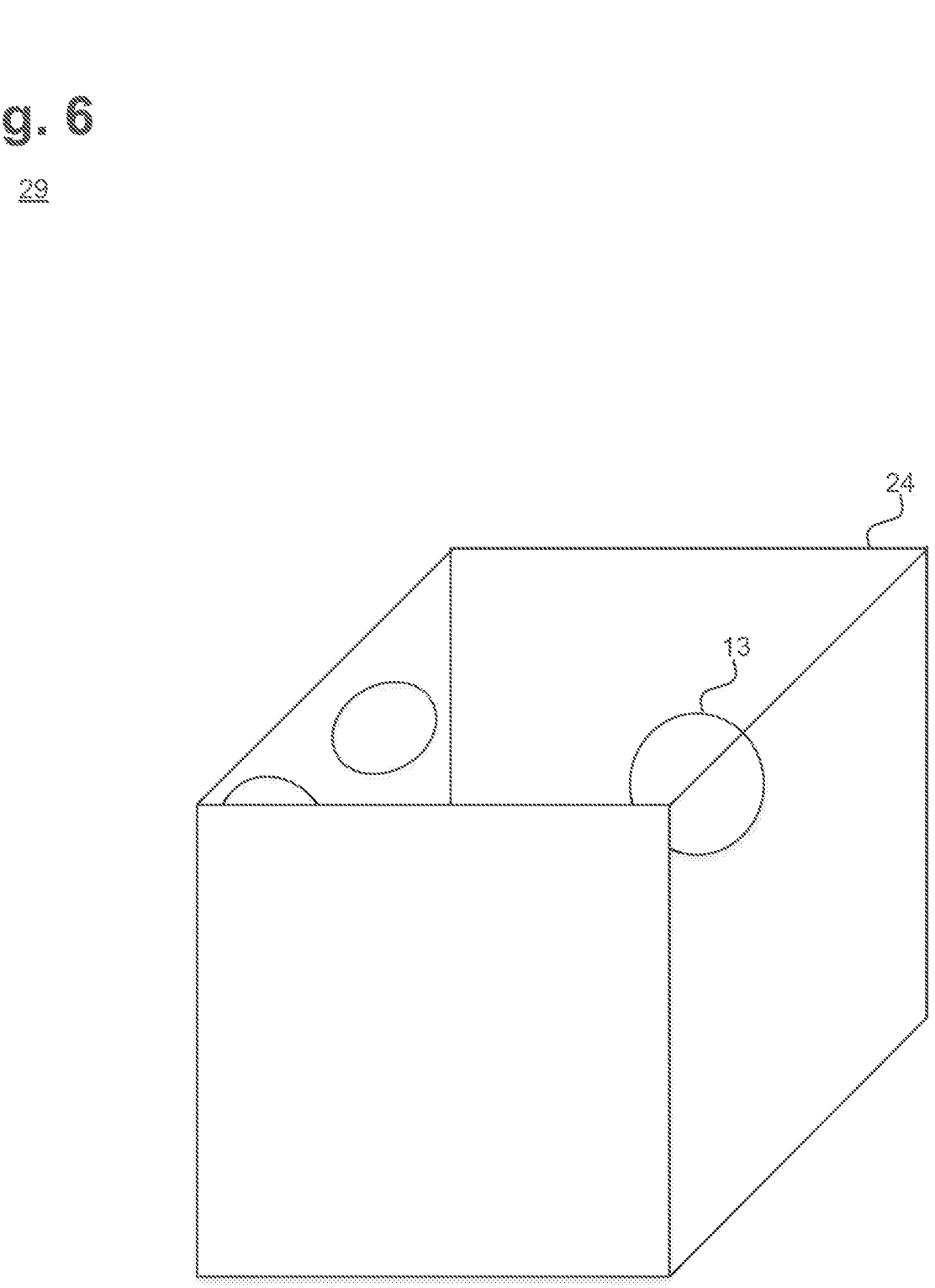
FIG. 6 is a view showing the base of the housing of the die of FIG. 1 in accordance with one embodiment.

A base 29 of the housing 11 is formed by machine stitching together four substantially square pieces of fused fabric pieces 24 (step 32) FIG. 6 is a view showing the base 29 of the housing 11 of the die of FIG. 1 in accordance with one embodiment. With reference to FIG. 6, the base 29 is shown as having the side of the fused material pieces 24 on which the markings 13 are visible face towards the inside of the base 29 when the fabric pieces 24 are machine stitched together.

Figure 7:
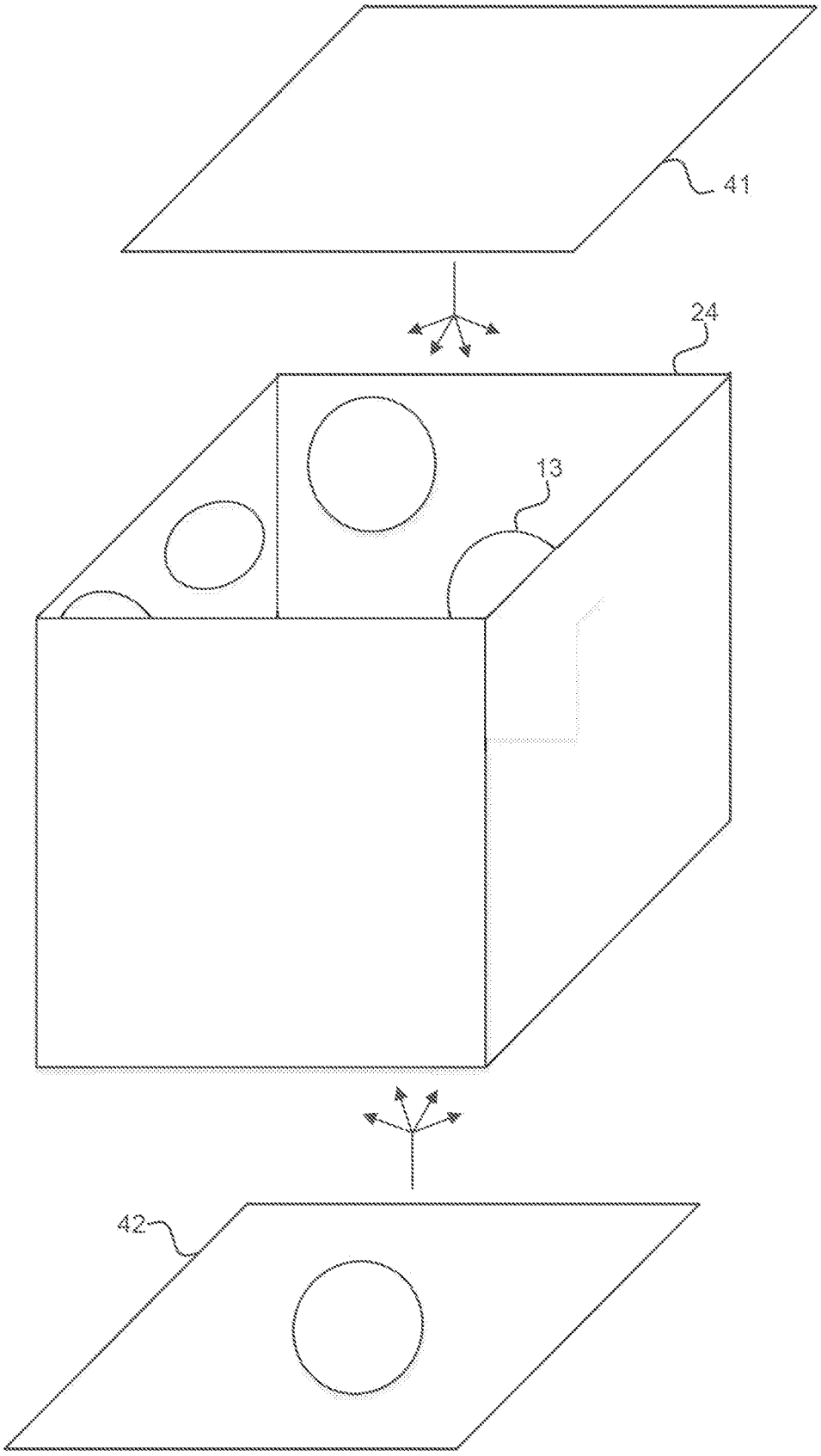
FIG. 7 is a view showing the base of the housing of the die together with the top fused fabric piece and the bottom fused fabric piece in accordance with one embodiment.

Returning to the method of FIG. 4, following the formation of the base 29, housing 11 (including the corners 16) is formed (step 33), as illustrated by FIG. 7. The corners are formed by machine stitching to the base 29 two additional pieces of fused material pieces 41, 42 (also referred to as fused fabric pieces 41, 42). The fused fabric pieces 41, 42 are structurally identical to the fused material pieces 24 forming the base 29 with the exception of bearing different markings 13. FIG. 7 is a view showing the base 29 of the housing of the die 10 together with the top fused material piece 41 and the bottom fused material piece 42 in accordance with one embodiment. One additional piece of fused materials 41 (the "top fused material piece 41" from hereon) is stitched to each of the top portions of the fused material pieces 24 forming the base 29. In particular, one section 26-28 of the top fused material piece 41 is sewn to one of the top portions 27 of one of the pieces forming the base 29 at a time. The top fused material piece 41 and the pieces 24 forming the base are right side in when the machine stitching is applied. Further, when the stitching is applied, the side of the top fused material piece 41 without markings is right side out. Similarly, another additional fused material piece 42 ("bottom fabric piece 42" from here on) is stitched to each of the bottom portions 28 of the housing fabric pieces 24 forming the base 29 in the same way.

The threads applied via matching stitching are threads 14*b*, thus being applied some distance from the edges of the fused material pieces 24, 41, 42. For example, such threads 14*b* can be applied to at least some of the portions of the fused material pieces 24 represented by the dashed lines seen with reference to FIG. 5, though other locations are possible. Further, one of the sections 26-28 of the top fused material piece 41 or the bottom fused material piece 42 is machine stitched to one of the sides in a way that creates the opening 20: two threads 14*a* are used to stitch portions of the top fused material piece 41 (or bottom fused material piece 42) that are separated by some space, thus creating the opening 20.

Following step 33, the housing 11 formed by the base 29 with the top fused material piece 41 and the bottom fused material piece 42 attached is turned inside out (step 34). The turning inside out can be accomplished by reaching inside the opening with one's fingers, grabbing the surface of one of the fused material pieces 24, 41, 42, and pulling the fabric pieces 24, 41, 42 through the opening 20 (though other ways to turn the base 29 with the top fabric piece 24 and the bottom fabric piece 24) are also possible.

Additional threads 14*a* are sewn into the fabric pieces near the edges of the fused material pieces 24, 41, 42, thus joining the top fused material piece 41 to the top portions 27 of the fabric pieces 24 forming the base 29 and the bottom fused material piece 42 to the bottom portions 28 of the fabric piece forming the base 29, thus reinforcing the integrity of the housing 11 as a whole and the corners 16 in particular (step 35). In one embodiment, the additional machine stitching does not include closing the opening 21, and thus the opening 20 remains after this step. In a further embodiment, step 35 and steps 36-37 can be switched and the threads 14*a* can be applied via machine stitching following insertion of the fabric layer 45 and filler material 20 into the housing 11.

Into the opening 20 are inserted some of the filler material 20 (step 36) and following the insertion of the filler material 20, the additional fabric filler 45 (such as a soft fabric) is inserted to cover at least that portion of the filler material 20 that is proximal to the opening 21 (step 37). The opening is closed by applying a single thread 14*a* by machine stitching to the fabric pieces forming the opening 20, with the fabric piece 24 forming part of the base 29 being right side out (step 38), ending the method 30.

While the invention has been particularly shown and described as referenced to the embodiments thereof, those skilled in the art will understand that the foregoing and other changes in form and detail may be made therein without departing from the spirit and scope of the invention.

What is claimed is:

1. A reinforced die for use in a throwing game, comprising:

a substantially cube-shaped housing comprised of a plurality of pieces of fabric, each of the pieces of fabric comprised of multiple layers, the housing comprising a plurality of sides, each side associated with a score used for a game, each corner of the housing formed by some of the fabric pieces joined by at least two threads applied via two applications of machine stitching, wherein one of the threads is applied with the fabric pieces being right side in and another one of the threads is applied with the fabric pieces being right side out; and a filler material inside the housing, wherein upon landing following being thrown during the game, the housing retains the substantially cube-shaped shape due to the filler material and the corners being formed via the two applications of machine stitching, and wherein one of the sides is a top side of the die upon the landing, and wherein the substantially-cube shaped housing comprises eight of the corners and wherein the fabric pieces forming each of six of the eight corners are joined by the same two threads as the fabric pieces forming another one of the six of the eight corners, wherein the threads joining each two of the six corners pass through portions of at least one of the fabric pieces forming those two corners.

2. A die according to claim 1, wherein at least an outer one of the layers of each of the pieces of fabric comprises duck cloth.

3. A die according to claim 2, wherein the layer of each of the fabric pieces adjacent to the outer layer comprises polyester.

4. A die according to claim 3, wherein edges of the polyester layer of each of the pieces are fused to edges of the outer layer of that piece.

5. A die according to claim 4, wherein portions of the polyester layer of each of the pieces other than the polyester layer edges are not fused to the outer layer of that fabric piece.

6. A die according to claim 5, further comprising a further piece of fabric within the housing that is not attached to the fabric pieces, the further piece of fabric in contact with the filler material.

7. A die according to claim 6, wherein the filler material comprises polyethylene pellets.

8. A die according to claim 1, wherein the two remaining of the eight corners are each joined by the threads different than the threads joining the six corners.

9. A die according to claim 8, wherein portions of the fabric pieces between the two remaining of the eight corners are joined only via one or more further threads.

* * * * *